US005782722A

United States Patent [19]

Sands et al.

[11] Patent Number: 5,782,722

[45] Date of Patent: Jul. 21, 1998

[54] STRUCTURE OF FOLDING COLLAPSIBLE STEP EXERCISER

[76] Inventors: Lenny Sands, 4555 Reseda Blvd., Tarzana, Calif. 91356; Johnson Kuo, 5F, No. 6, Lane 12, Sec. 6, Hsin I Rd., Taipei, Taiwan

[21] Appl. No.: 918,104

[22] Filed: Aug. 27, 1997

[51] Int. Cl.[6] ..... A63B 69/16; A63B 22/04

[52] U.S. Cl. ..... 482/52; 482/51; 482/57; 482/70

[58] Field of Search ..... 482/51, 52, 53, 482/57, 70, 79, 80; 434/255

[56] References Cited

U.S. PATENT DOCUMENTS

| | | | |
|---|---|---|---|
| 5,383,829 | 1/1995 | Miller | 482/51 |
| 5,549,526 | 8/1996 | Rodgers | 482/51 |
| 5,577,985 | 11/1996 | Miller | 482/57 |
| 5,593,372 | 1/1997 | Rodgers, Jr. | 482/52 |
| 5,647,821 | 7/1997 | Johnston | 482/57 |

*Primary Examiner*—Stephen R. Crow

*Attorney, Agent, or Firm*—Varndell Legal Group

[57] ABSTRACT

A folding collapsible step exerciser including a base frame, a front upright pivoted to a front side of the base frame and locked in a vertical position by a lock screw, a driving wheel revolvably supported on the base frame and having a double crnak type fixed wheel shaft, a damping wheel turned with the driving wheel, a friction belt mounted on the base frame and adapted to import a friction resistance to the damping wheel, two handlebars bilaterally pivoted to the front upright, and two pedals having a respective front end respectively pivoted to the bottom ends of the handlebars and a respective rear end respectively Pivoted to the two ends of the double crank type wheel shaft of the driving wheel, wherein one pedal has a U-frame invertedly and fixedly secured to its rear end, the U-frame having two screw holes aligned at its two parallel side walls; one end of the fixed wheel shaft of the driving wheel has a screw hole mounted with a screw bolt to hold a barrel, the barrel being coupled to the U-frame and secured in place by a locating screw which is threaded into the screw holes of the U-frame and stopped below the barrel, the barrel having two flanges raised around its two opposite ends and bilaterally stopped outside the U-frame.

1 Claim, 9 Drawing Sheets

STRUCTURE OF FOLDING COLLAPSIBLE STEP EXERCISER

BACKGROUND AND SUMMARY OF THE INVENTION

The present invention relates to an improved structure of folding collapsible step exerciser.

U.S. patent application Ser. No. 08/886, 937, discloses a step exerciser, as shown in FIGS. 1 and 2, which can be conveniently folded up into a collapsed condition when not in use. This structure of folding collapsible step exerciser is functional, however when the folding collapsible step exerciser is arranged in the collapsed condition as shown in FIG. 2, the left handelbar, the right handlebar, the left pedal and the right pedal can not be closely attached to the front upright of the base.

The present invention improves the aforesaid drawback. According to the present invention, one pedal has a U-frame invertedly and fixedly secured to its rear end. The U-frame has two screw holes alinged at its two parallel side walls. One end of the fixed wheel shaft of the driving wheel has a screw hole mounted with a screw bolt to hold a barrel. The barrel is coupled to the U-frame and secured in place by a locating screw, which is threaded into the screw holes of the U-frame and stopped below the barrel. The barrel has two flanges raised around its two opposite ends and bilaterally stopped outside the U-frame. When to collapse the step exerciser, the locating screw is removed from the U-frame and the lock screw is removed from the front upright and the base of the step exerciser, and then the front upright with the pedals and the handlebars of the step exerciser are folded up and collapsed.

DETAILED DESCRIPTION OF THE PREFERRED EMBODIMENT

Figure 1:
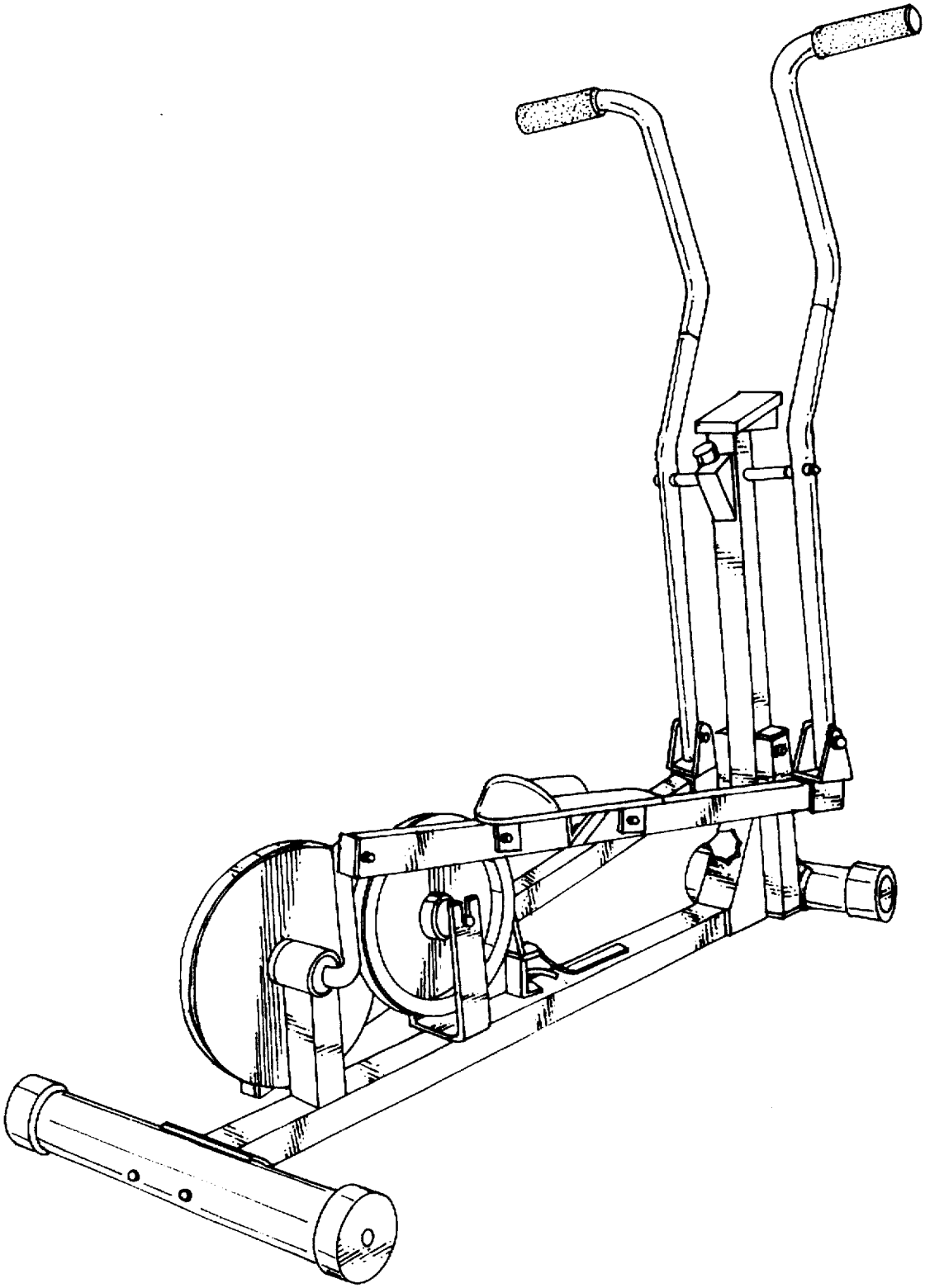
Fig. 1 PRIOR ART
FIG. 1 is an elevational view of a folding collapsible step exerciser according to U.S. patent application Ser. No. 08/886,937.
Figure 2:
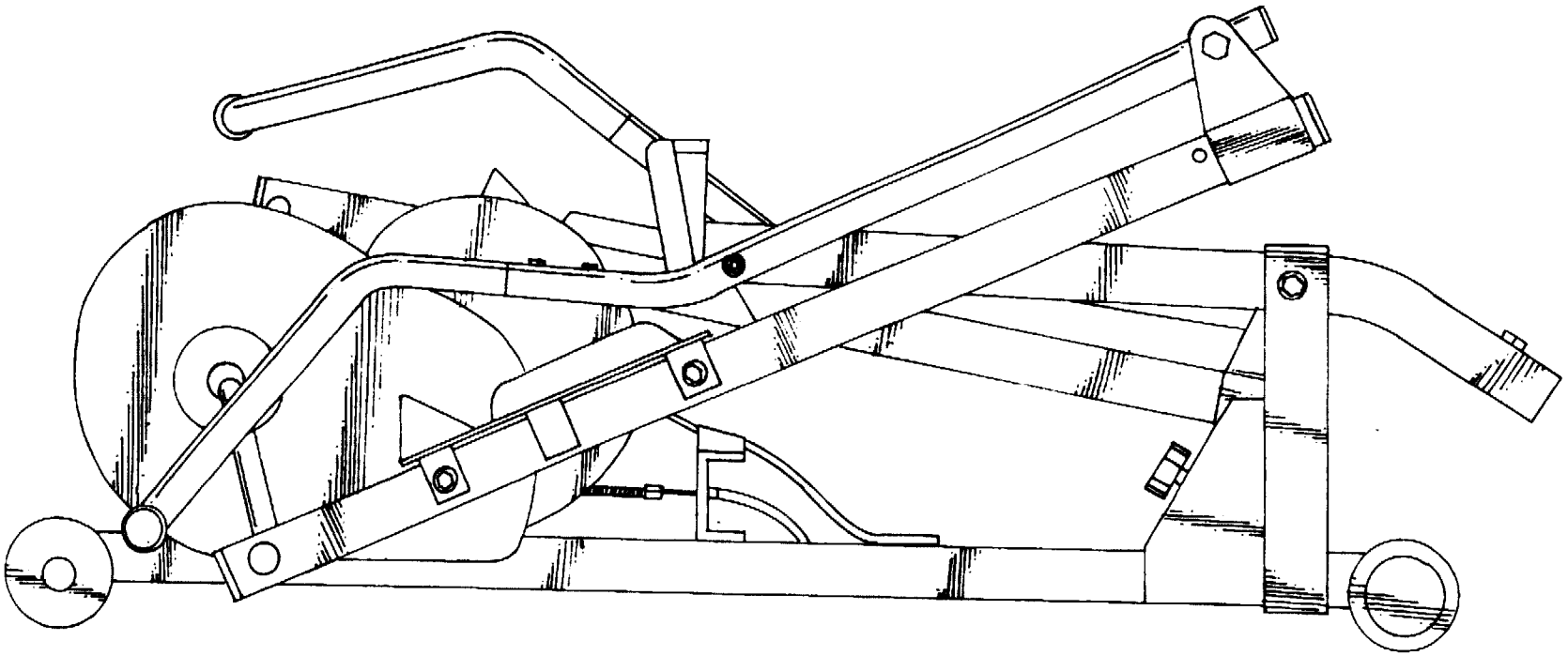
Fig. 2 PRIOR ART
FIG. 2 shows the folding collapsible step exerciser of FIG. 1 collapsed.
Figure 3:
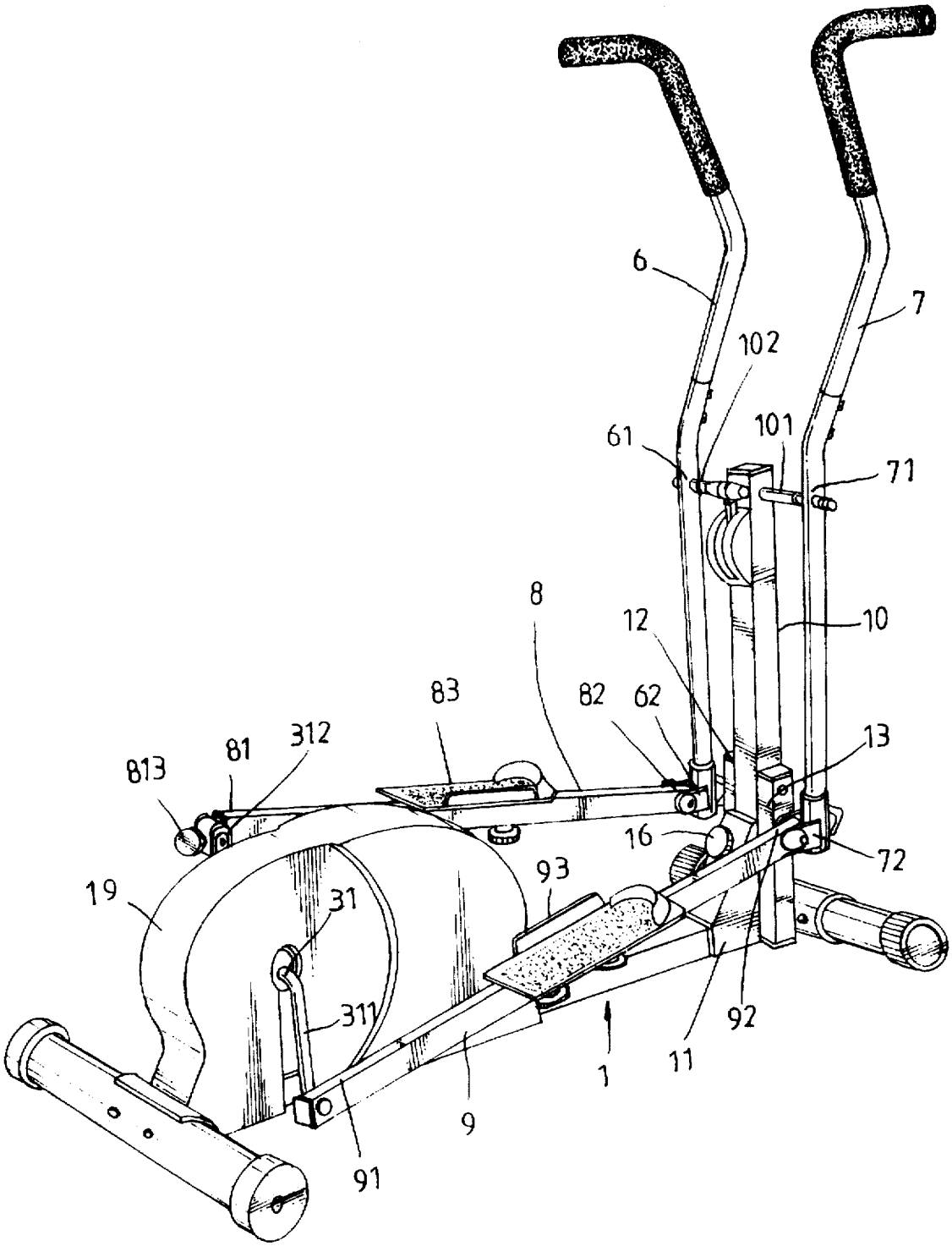
FIG. 3 is an elevational view of a folding collapsible step exerciser according to the present invention.
Figure 4:
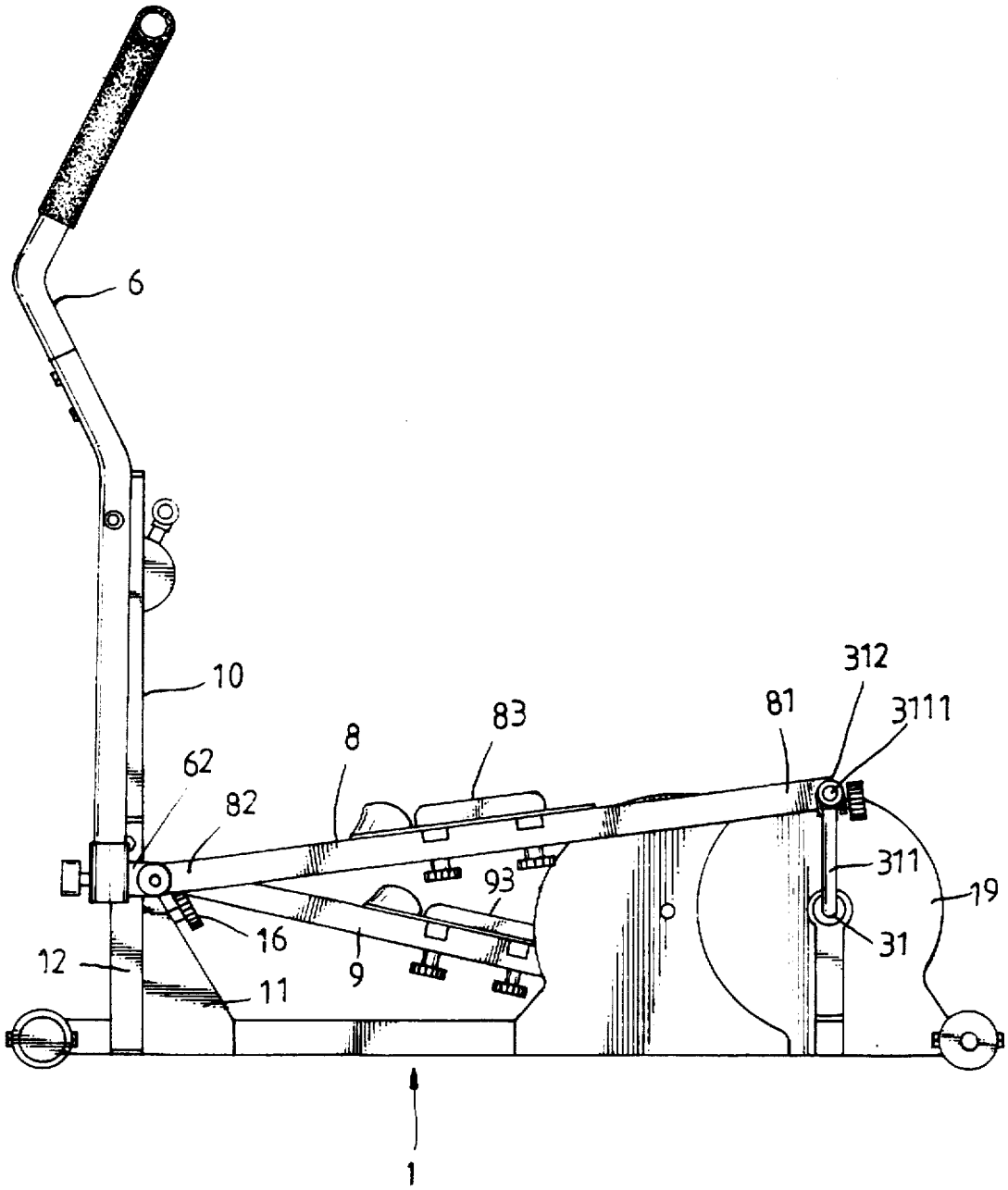
FIG. 4 is a side view of the folding collapsible step exerciser shown in FIG. 3.
Figure 5:
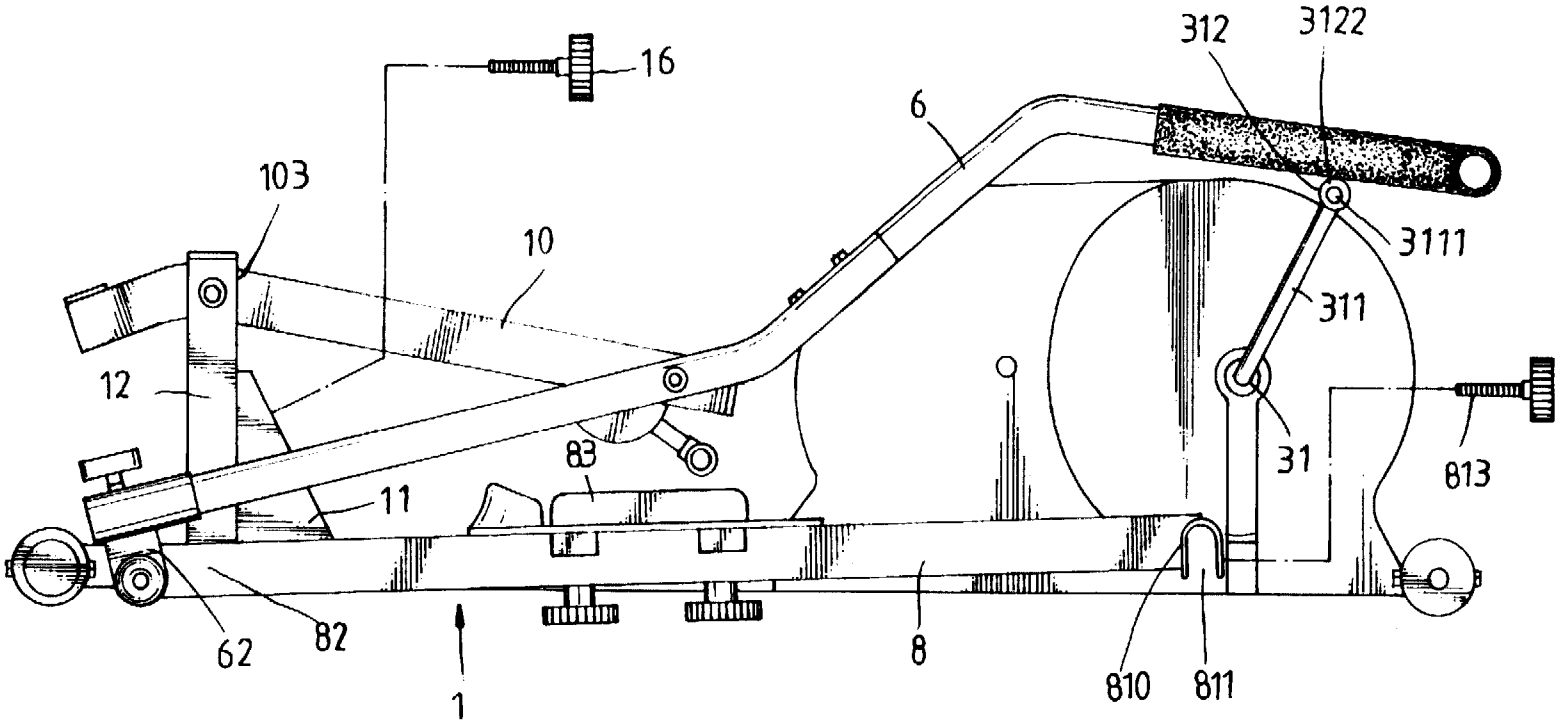
FIG. 5 is another side view of the present invention, showing the folding collapsible step exerciser collapsed.

Referring to FIGS. from 3 to 9, a folding collapsible step exerciser in accordance with the present invention is generally comprised of a base frame 1, a front upright 10, a substantially U-shaped damping wheel holder frame 2, an idle wheel 301, a transmission belt 40, a damping wheel 5, a damping device 50, a driving wheel 3, a left handelbar 6 and a right handlebar 7, a left pedal 8 and a right pedal 9.

The base frame 1 comprises a front mounting block 11, two front supports 12; 13 bilaterally and fixedly fastened to the front mounting block 11 at the front side, a rear support 15, and an axle housing 151 transversely and fixedly mounted on the rear support 15 at its top.

The front upright 10 is pivotably connected between the front supports 12; 13 of the base frame 1 having a bottom end releasably secured to the front mounting block 11 of the base frame 1 by a lock screw 16 and a top end fixedly mounted with two horizontally aligned pivoted 101; 102.

Figure 6:
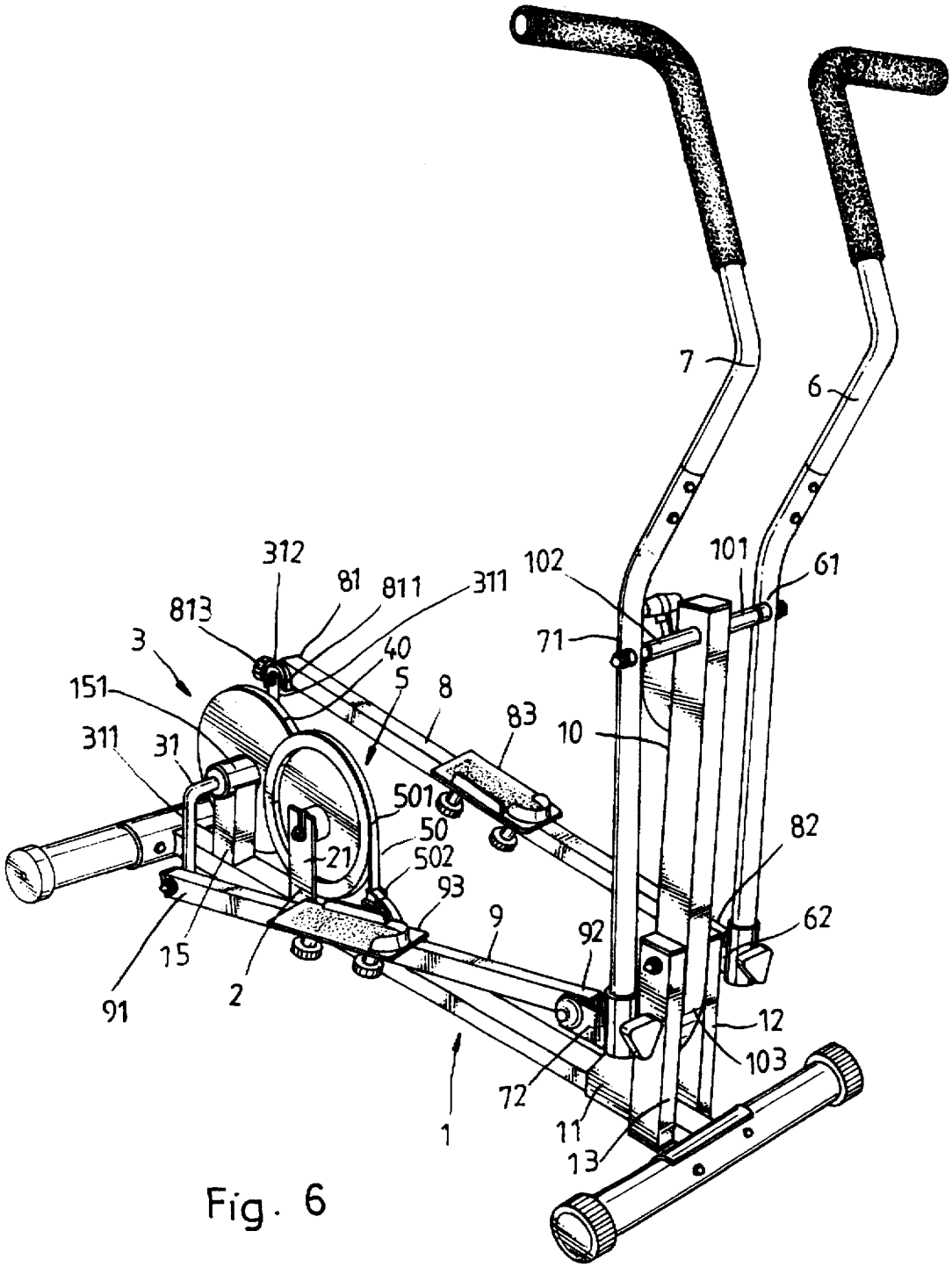
FIG. 6 is another elevational view of the present invention showing the guard frame removed.

The U-frame damping wheel holder frame 2 is fixedly mounted on the base frame 1 between the front supports 12;13 and the rear support 15, having two upright arms 21 adapted to support the damping wheel 5 and the idle wheel 301 (see FIG. 6).

The idle wheel 301 is pivoted to one arm 21 of the U-shaped damping wheel holder frame 2, and adapted to impart a pressure to the transmission belt 40.

Figure 7:
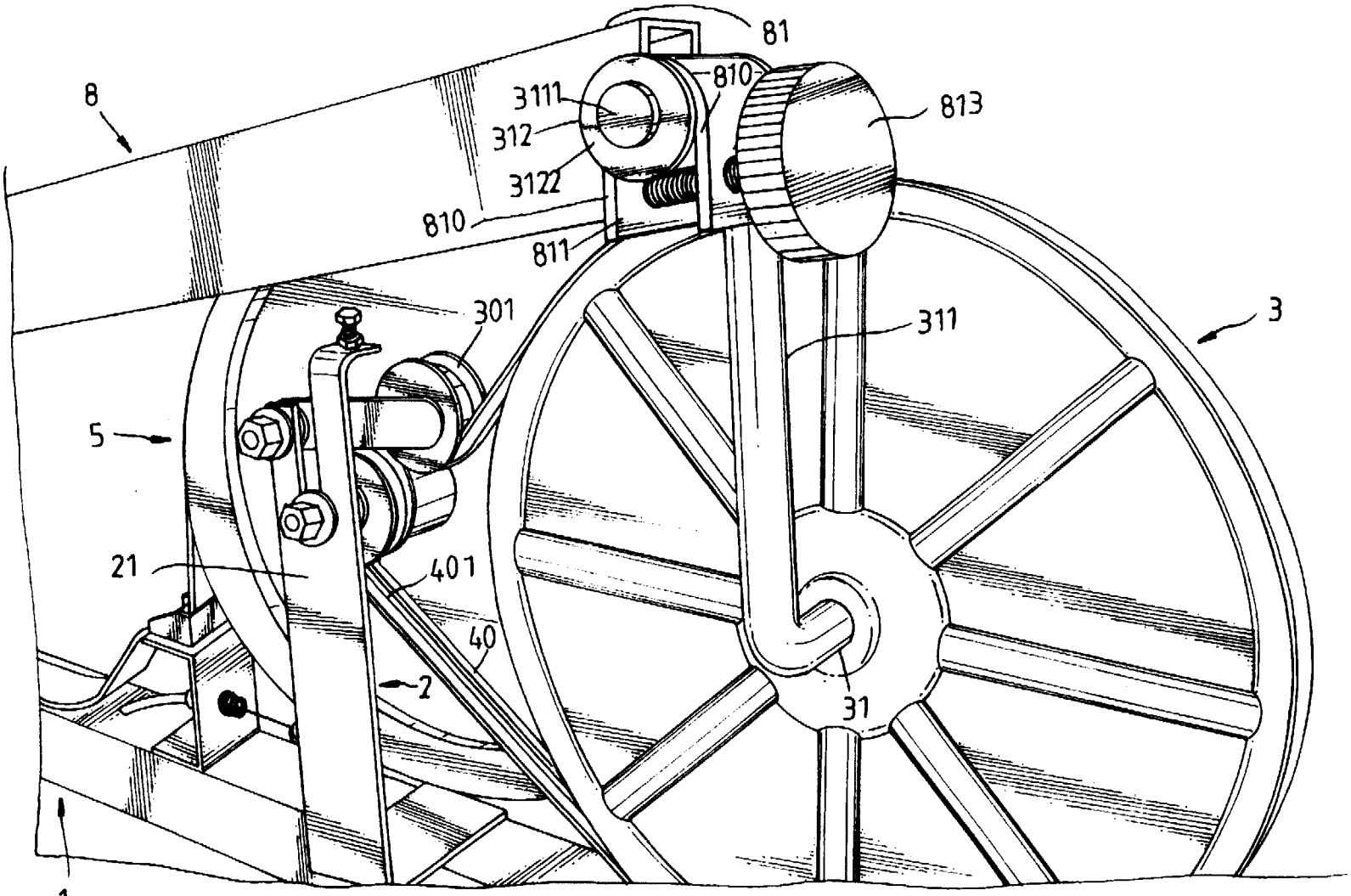
FIG. 7 is an enlarged view of the rear part of FIG. 6.
Figure 8:
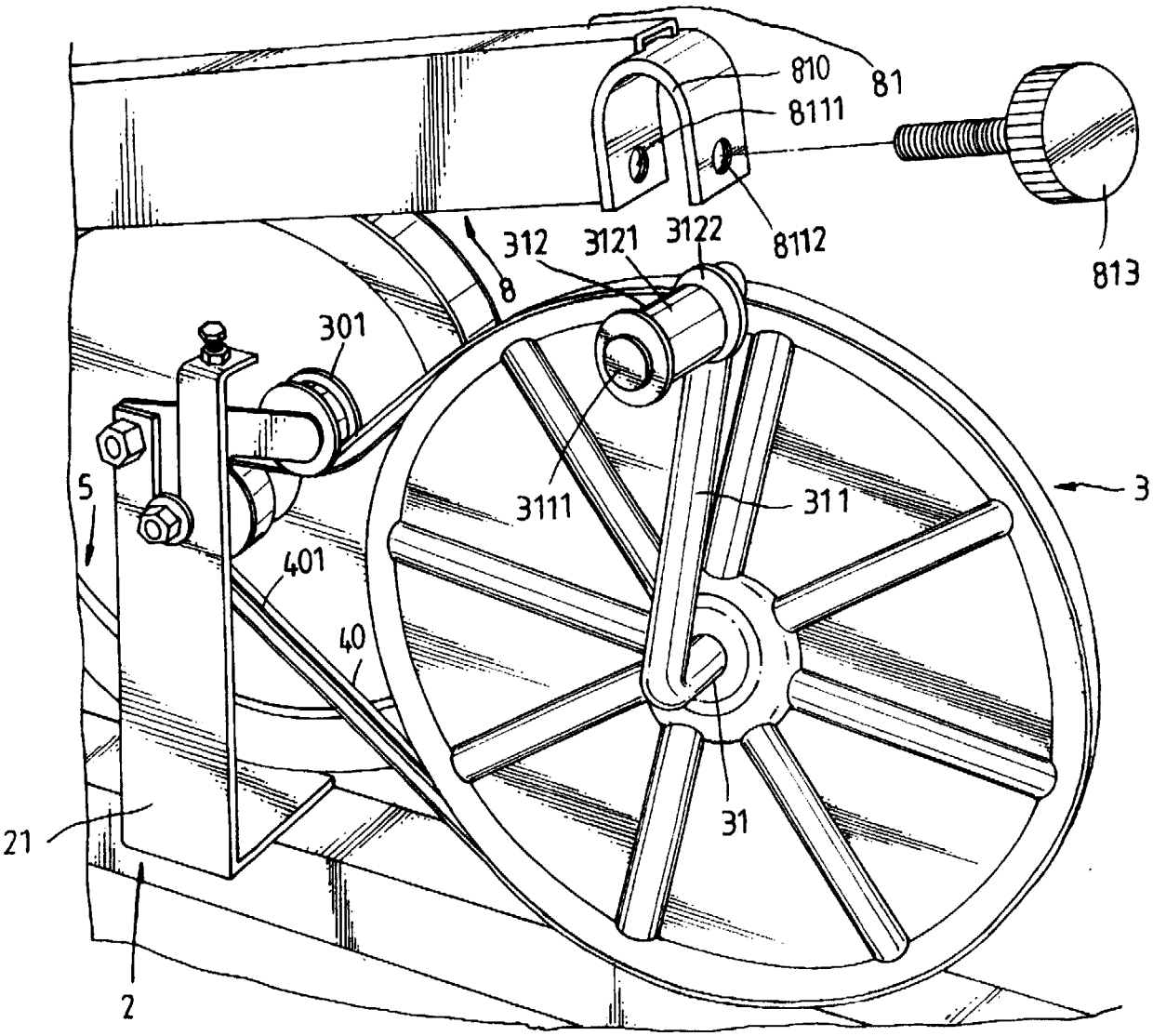
FIG. 8 is similar to FIG. 7 but showing the locating screw removed from the U-frame, the U-frame of the left pedal disconnected from the barrel and the fixed wheel shaft of the driving wheel.
Figure 9:
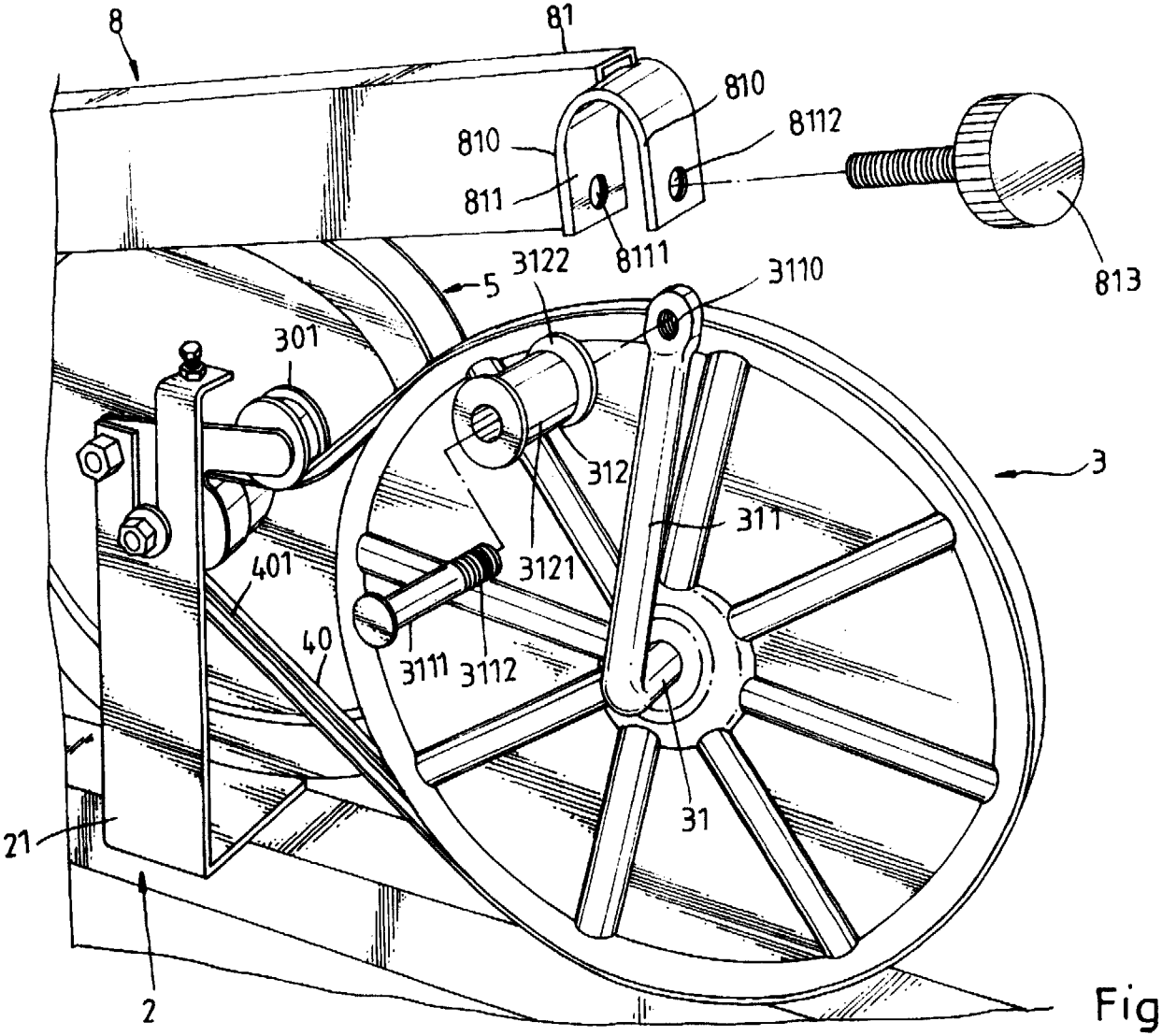
FIG. 9 is similar to FIG. 7 but showing the screw bolt disconnected from the fixed wheel shaft of the driving wheel and the barrel is connected from the screw bolt.

The damping wheel 5 is revolvably supported on the upright arms 21 of the U-shaped damping wheel holder frame 2, and coupled to one side 401 of the transmission belt 40 (see FIG. 7).

The damping device 50 comprises a friction belt 501 mounted on the base frame 1 over the periphery of the damping wheel 5 and imparting a friction resistance to the damping wheel 5, and an adjustment device 502 controlled to adjust the tension of the friction belt 501.

The driving wheel 3 is revolvably supported on the axle housing 151 of the base frame 1, having a fixed wheel shaft 31 made in the form of a double crank with its two ends 311 respectively pivoted to the pedals 8;9.

The pedals 8;9 have a respective rear end 81; 91 respectively pivoted to the two opposite ends 311 of the fixed wheel shaft 31, and a respective front end fixedly mounted with a respective front end 82; 92 adapted for coupling to the handelbars 6; 7. Further, two foot plates 83;93 are respectively mounted on the pedals 8;9 at the top adjacent their rear ends 81;91.

The handlebars 6;7 have a respective middle part 61;71 respectively pivoted to the pivots 101; 012 of the front upright 10, and a respective bottom U-frame 62 ; 72 respectively Pivoted to the front ends 82; 92 of the pedals 8;9.

Further, a guard frame 19 is mounted on the base frame 1 and covered over the driving wheel 3 and the damping wheel 5 for protection.

When in use, the handlebars 6;7 are grasped with the hands and alternatively pushed and pulled, and the legs are laternatively stepped on the foot plates 83;93. When pedaling the pedals 8;9, the driving wheel 3 is rotated to turn damping wheel 5, and the friction belt 501 imparts a friction resistance to the damping wheel 5 against the driving power from the user's legs. When not in use, the lock screw 16 is disconnected from the front upright 10, permitting the front upright 10 and the handlebars 6;7 to be folded up and closely attached to the base frame 1 to minimize space occupation.

The improvement of the present invention is outlined hereinafter with reference to FIGS. from 7 to 9 again. One of the pedals 8; 9, for example, the left pedal 8 comprises an invertedly disposed U-frame 811 fixedly secured to its rear end 81, and two screw holes 8111; 8112 aligned at two parallel side walls 810 of the U-frame 811. One end 311 of the fixed wheel shaft 31 has a screw hole 3110. A screw bolt 3111 is provided with its threaded rod 3112 threaded into the screw hole 3110 of one end 311 of the fixed wheel shaft 31 to hold a barrel 312. The barrel 312 comprises a cylindrical body 3121 supported on the screw bolt 3111 and coupled to the U-frame 811 of the left pedal 8, and two flanges 3122 raised around its two opposite ends and bilaterally stopped outside the U-frame 811. A locating screw 813 is threaded into the screw holes 8112; 8111 of the U-frame 811 to secure the barrel 312 and the U-frame 811 together. Because the flanges 3122 of the barrel 312 are bilaterally stopped outside the U-frame 811 and the barrel 312 is stopped from downward movement by the locating screw 813, driving power from the left pedal 8 is smoothly and stably transmitted to the fixed wheel shaft 31 and the driving wheel 3.

When to collapse the step exerciser the locating screw 813 is removed from the U-frame 811, permitting the left pedal 8 to be disconnected from the fixed wheel shaft 31 of the driving wheel 3, and then the lock screw 16 is removed from the front mounting block 11 of the base frame 1, permitting the front upright 10 with the pedals 8;9 and the handlebars 6; 7 to be collapsed.

We claim:

1. A folding collapsible step exerciser comprising :

a base frame having a front mounting block, two front supports bilaterally and fixedly fastened to said front mounting block, a rear support, and an axle housing transversely and fixedly mounted on a top end of said rear support;

a front upright Pivotably connected between said front supports of said base frame by pivot means, having a bottom end releasably secured to said front mounting block of said base frame by a lock screw and a top end fixedly mounted with two horizontally aligned pivots;

an U-shaped damping wheel holder frame fixedly mounted on said base frame between said front supports and said rear support, having two upright arms;

a driving wheel revolvably supported on said axle housing of said base frame, having a fixed wheel shaft made in the form of a double crank;

a damping wheel revolvably supported on said upright arms of said U-shaped damping wheel holder frame, having a coupling portion at one side coupled to said driving wheel;

a transmission belt coupled between said driving wheel and the coupling portion of said damping wheel for permitting said damping wheel to be turned with said driving wheel;

a damping device, said damping device comprising a friction belt mounted on said base frame over the periphery of said damping wheel and imparting a friction resistance to said damping wheel, and an adjustment device controlled to adjust the tenion of said frction belt;

an idle wheel pivoted to one upright arm of said U-shaped damping wheel holder frame, and imparting a pressure to said transmission belt to keep it stretched;

two pedals driven to turn said driving wheel, said pedals having a respective rear end respectively pivoted to two opposite ends of said fixed wheel shaft of said driving wheels, a respective front end fixedly mounted with a respective front end, and a respective foot plate disposed at a top side adjacent the respective rear end; and two handlebar respectively turned about the pivots of said front upright, and a respective bottom end respectively pivoted to the bottom U-frames of said pedals; wherein one of said pedals has a U-frame invertedly and fixedly secured to its rear end, said U-frame having two screw holes aligned at two parallel side walls thereof; one end of the fixed wheel shaft of said driving wheel has a screw hole mounted with a screw bolt to hold a barrel, said barrel being coupled to said U-frame and secured in place by a locating screw, which is threaded into the screw holes of said U-frame and stopped below said barrel, said barrel having two flanges raised around two opposite ends thereof and bilaterally stopped outside said U-frame.

* * * * *